US008370982B2

(12) United States Patent
Peters

(10) Patent No.: US 8,370,982 B2
(45) Date of Patent: Feb. 12, 2013

(54) RAMP

(75) Inventor: Andrew Peters, Nr Pershore (GB)

(73) Assignee: DLP Limited, Douglas, British Isles (IM)

( * ) Notice: Subject to any disclaimer, the term of this patent is extended or adjusted under 35 U.S.C. 154(b) by 29 days.

(21) Appl. No.: 13/192,093

(22) Filed: Jul. 27, 2011

(65) Prior Publication Data

US 2012/0036653 A1 Feb. 16, 2012

(30) Foreign Application Priority Data

Aug. 16, 2010 (GB) ..... 1013705.7

(51) Int. Cl.
*E01F 1/00* (2006.01)
*B65G 69/28* (2006.01)

(52) U.S. Cl. ..... 14/69.5

(58) Field of Classification Search ..... 14/69.5
See application file for complete search history.

(56) References Cited

U.S. PATENT DOCUMENTS

| | | | | |
|---|---|---|---|---|
| 4,807,317 | A | 2/1989 | Quinn et al. | |
| 4,912,796 | A | 4/1990 | Crump | |
| 5,214,817 | A * | 6/1993 | Allen | 14/69.5 |
| 6,676,358 | B2 * | 1/2004 | Smith | 414/340 |
| 6,898,815 | B2 * | 5/2005 | Young et al. | 14/69.5 |
| 7,010,825 | B1 * | 3/2006 | Finch Salas et al. | 14/72.5 |
| 7,240,388 | B2 * | 7/2007 | Warford | 14/69.5 |
| 7,607,186 | B1 | 10/2009 | Mitchell | |
| 2004/0250360 | A1 * | 12/2004 | Young et al. | 14/69.5 |
| 2006/0059636 | A1 * | 3/2006 | Suggate | 14/69.5 |
| 2008/0184502 | A1 * | 8/2008 | Roberts | 14/71.1 |
| 2009/0300860 | A1 | 12/2009 | Campbell | |

FOREIGN PATENT DOCUMENTS

| | | |
|---|---|---|
| AU | 577569 B | 8/1985 |
| CN | 201010379 | 1/2008 |
| JP | 2002167933 | 6/2002 |
| JP | 2007138480 A | 6/2007 |
| JP | 2010196385 A | 9/2010 |

* cited by examiner

*Primary Examiner* — Raymond W Addie
(74) *Attorney, Agent, or Firm* — Larkin Hoffman Daly & Lindgren; Robert C. Klinger

(57) ABSTRACT

A ramp which comprises a user support element, an edge element at an edge of the user support element, a handrail, a support connector which is slidably engagable with the edge element, an elongate upright handrail support, and an adjustable elongate depending ramp support. The handrail support and the ramp support are coaxially held by the support connector. The ramp may also comprise a user support element, an edge element at an edge of the user support element, and a height adjustable ramp support which includes a foot and two arms pivotably engaged with the foot. Each arm has a slider pivotably engaged at its distal end remote from the foot, and each slider is slidably engagable with the edge element for lengthwise adjustment of the ramp support along the edge element and for slidable adjustment relative to each other so as to set a distance between the edge element and the foot. Each slider is further fixedly holdable in place to maintain its set position.

20 Claims, 3 Drawing Sheets

RAMP

The present invention relates to a ramp, and more particularly to a modular ramp which is suitable for an elderly and/or infirm user, possibly being wheelchair bound.

BACKGROUND OF THE INVENTION

Ramps are widely used to provide access for the disabled to their domestic properties, places of work and shops. However, even though modular in nature to accommodate different installation environments, the ramps are still onerous to install, typically requiring significant amounts of cutting, fastening, adjustment, and even welding. This kind of installation is generally beyond the normal user and requires specialist trained installers.

Furthermore, the design of many ramps is unforgiving if a user knocks or bumps for example into its handrail. This is of particular concern for an older user who is liable to bruise and mark much more easily.

Additionally, ramps must often be installed on uneven ground, requiring particular positioning and adjustment of the ground supports.

The present invention seeks to provide solutions to these problems.

SUMMARY OF THE INVENTION

According to a first aspect of the invention, there is provided a ramp comprising a user support element, an edge element at an edge of the user support element, a handrail, a support connector which is slidably engagable with the edge element, an elongate upright handrail support, and an adjustable elongate depending ramp support, the handrail support and the ramp support being coaxially held by the support connector. A ramp as claimed in claim 1, wherein the ramp support is slidably adjustable relative to the handrail support.

Preferably, the ramp support is slidably telescopically extendable from and retractable into the handrail support. Furthermore, the ramp may further comprise a releasable detent for holding the ramp support in a selected position relative to the handrail support and support connector. The handrail support may conveniently be directly engagable with the support connector, and the ramp support is indirectly engagable with the support connector.

A single fastener preferably engages the support connector with the edge element and the handrail support and ramp support with the support connector. In this case, the single fastener may fixedly engage the support connector against sliding movement with the edge element. Furthermore, the single fastener may also engage the edge element with the user support element.

The support connector is preferably open ended to receive the handrail support and the ramp support coaxially therein. Beneficially, the support connector may include a connector body for receiving the handrail support and the ramp support, and a projecting runner which is slidably engagable with a channel of the edge element. The runner of the support connector may be a key and the channel of the edge element may be a keyway.

Preferably, the runner extends at right angles to the longitudinal extent of the support connector. The channel may be in a side wall of the edge element.

Advantageously, the connector body of the support connector has an increased wall thickness in the vicinity of the runner. The edge element may provide a kick plate which projects above an upper surface of the user support element.

The user support element and edge element are preferably modular for ramps of different lengths.

According to a second aspect of the invention, there is provided a ramp comprising a user support element, an edge element at an edge of the user support element, and a height adjustable ramp support which includes a foot and two arms pivotably engaged with the foot, each arm having a slider pivotably engaged at its distal end remote from the foot, each slider being slidably engagable with the edge element for lengthwise adjustment of the ramp support along the edge element and for slidable adjustment relative to each other so as to set a distance between the edge element and the foot, each slider being fixedly holdable in place to maintain a set position.

Preferably, each slider includes a slider body which is pivotably engaged with the distal end of the arm, and a projecting runner which is slidably engagable with a channel of the edge element. The runner of the support connector may be a key and the channel of the edge element may be a keyway. Beneficially, the runner may extend from an upper surface of the slider body.

The channel preferably extends longitudinally in a bottom surface of the edge element. Furthermore, the slider body may straddle the distal end of the arm.

Conveniently, the arm may be rectilinear. The arms may also have a common pivot axis at the foot.

Preferably, the ramp further comprises a releasable fastening device for fixedly holding each slider at its set position. In this case, the releasable fastening device is a screw-threaded fastener which can immovably fasten the slider to the edge element. Advantageously, the fastening device may be a nut which is tightenable down onto the edge element.

The arms preferably have fixed longitudinal extents. Furthermore, the arms may be length adjustable. Additionally, the arms may have telescopically adjustable lengths.

The foot may be pivotable relative to both said arms simultaneously.

According to a third aspect of the invention, there is provided a ramp comprising a user support element, an edge element at an edge of the user support element, and a height adjustable ramp support which includes a foot and two arms, each arm having a part-spherical pivot element at a proximal end thereof, each pivot element being abuttable with the other pivot element to provide a part-spherical head element, the foot including a cup having a part-spherical bearing surface which is complimentarily shaped to captively engage the part-spherical head element whereby the pivot elements can independently pivot relative to each other and the foot can pivot independently of the pivot elements in at least the plane of the arms and laterally of the arms.

Preferably, the foot is snap-fittably engagable with the part-spherical head element. Furthermore, each pivot element may include a flat which is abuttable with the flat of the other pivot element to provide the part-spherical head element. Additionally, the part-spherical head element is preferably symmetrical about the abutting plane of the pivot elements.

The arms may include an elongate arm member which extends from the respective pivot element. Each arm member preferably has a longitudinal extent which is parallel or substantially parallel to a plane of an abutment surface of the respective pivot element. Each arm member may act as a stop against which the foot is abuttable to limit articulation. Furthermore, each arm is preferably only pivotable in or substantially in a single plane.

Beneficially, the foot may be rotatable through 360 degrees on the part-spherical head element. The foot can preferably pivot in at least two perpendicular directions. The foot may also be substantially trapezoidal shaped.

Preferably, distal ends of the arms are adjustable engagable with the edge element. Furthermore, the edge element is independently engagable with the user support element.

The ramp may be in the form of a kit of parts.

The invention will now be more particularly described, by way of example only, with reference to the accompanying drawings.

DESCRIPTION OF THE PREFERRED EMBODIMENTS

Figure 1:
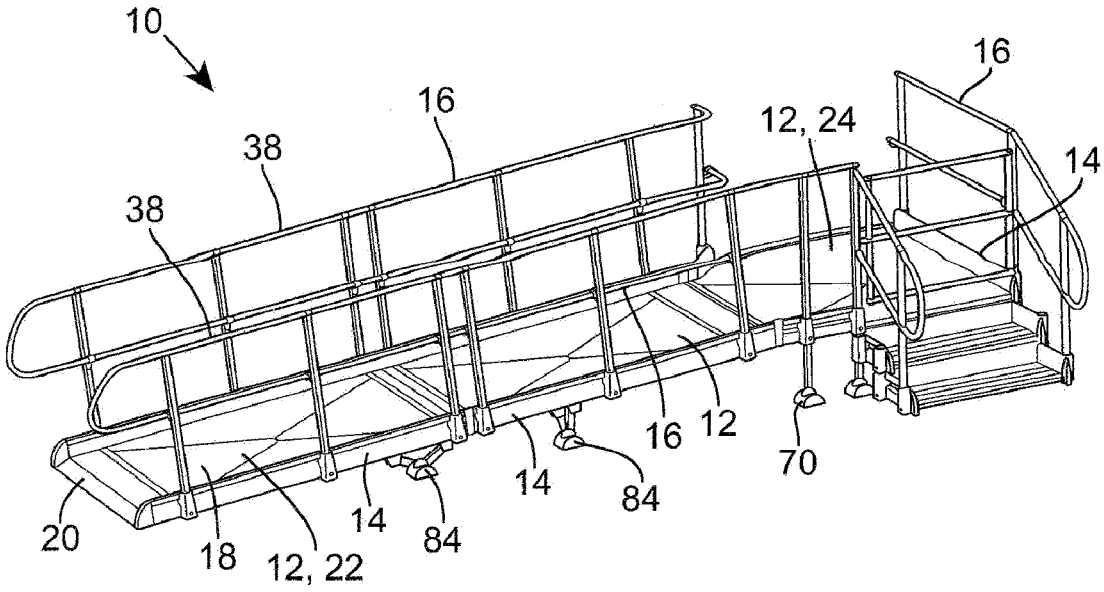
FIG. 1 shows a first perspective view of one embodiment of a ramp from a ramp edge end and in accordance with the present invention.
Figure 2:
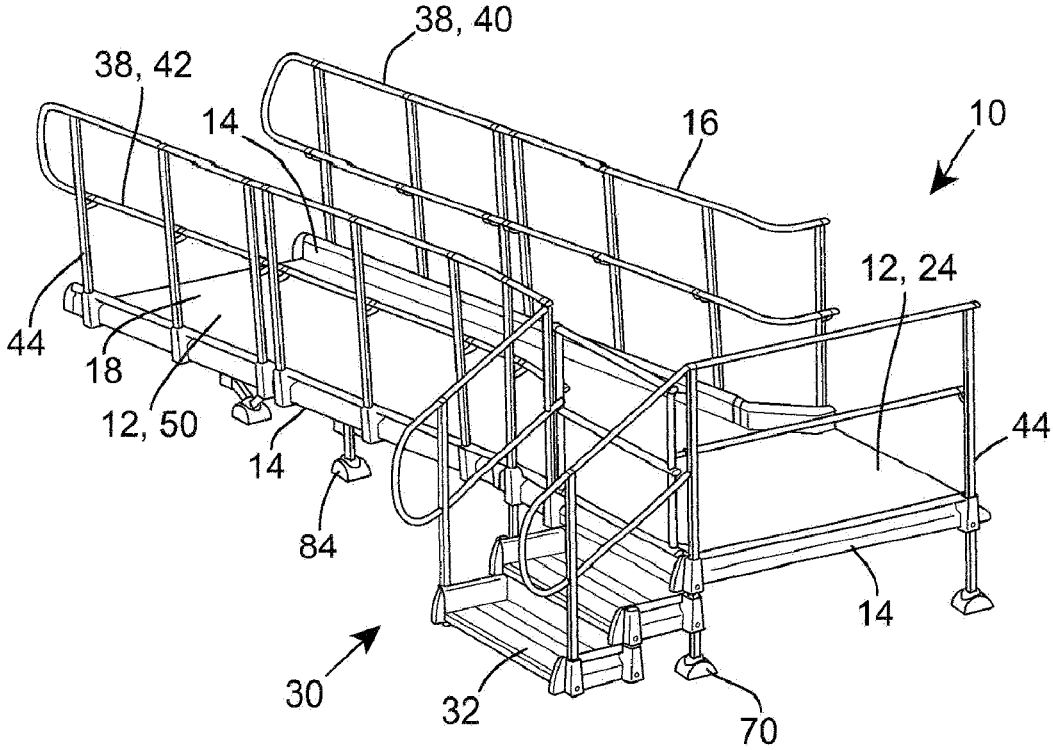
FIG. 2 shows a second perspective view of the ramp from a step end.
Figure 3:
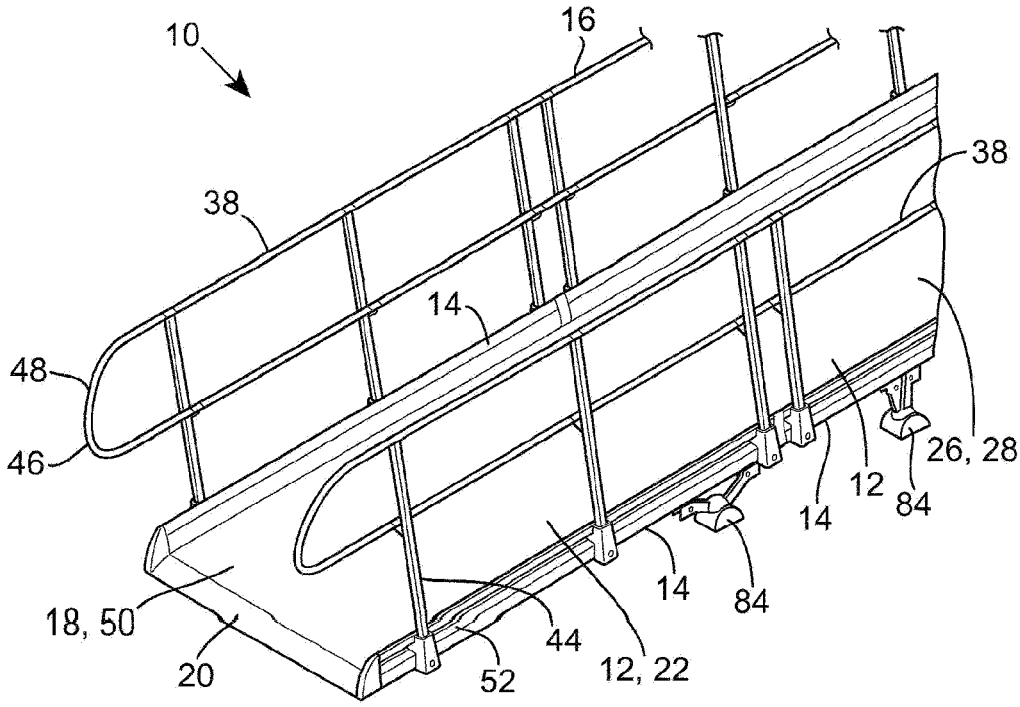
FIG. 3 shows an enlarged view of the ramp edge end.
Figure 4:
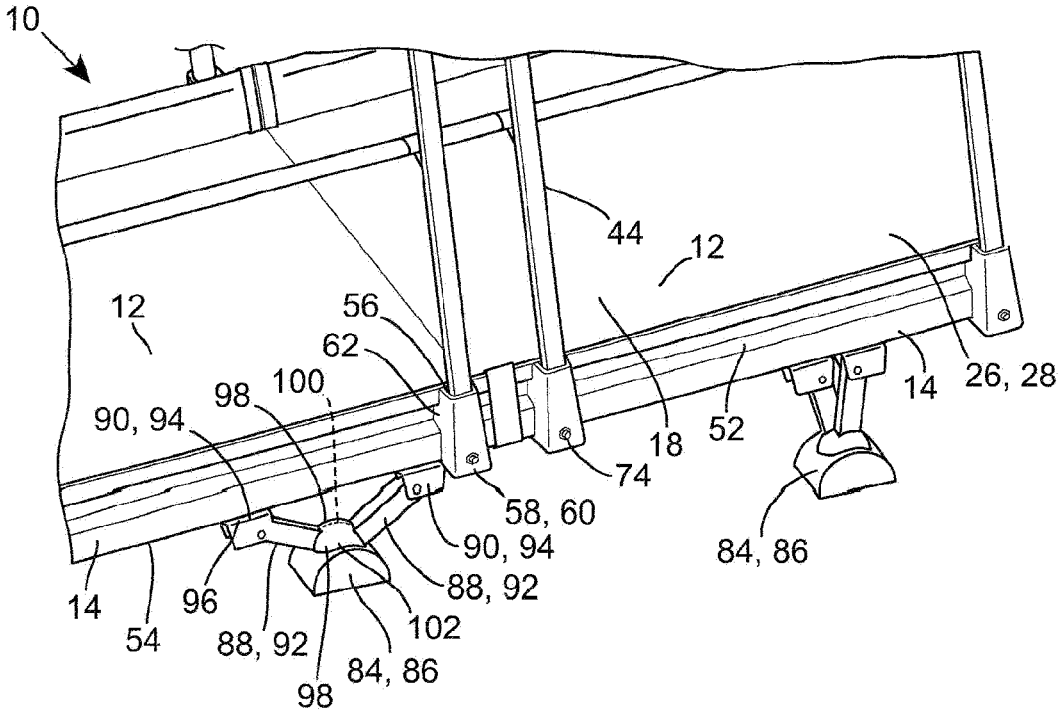
FIG. 4 shows an enlarged view of a first height adjustable ramp support of the ramp.
Figure 5:
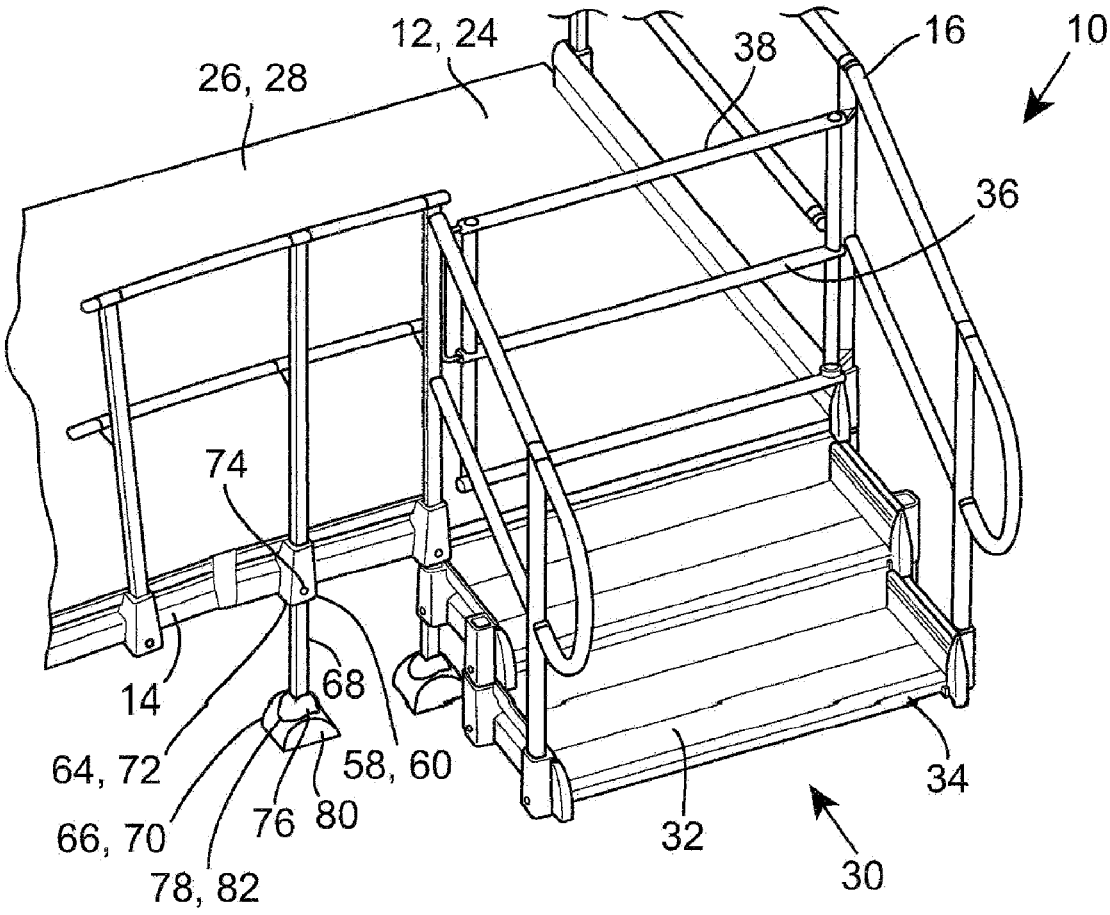
FIG. 5 shows an enlarged view of a second height adjustable ramp support, a handrail support, and a support connector.

Referring to the drawings, there is shown a ramp 10 which is modular in nature, comprising a plurality of user support elements 12, a plurality of edge elements 14, and a handrail 16. The user support elements 12 are common for a ramped portion 18 of the ramp 10, thereby enabling accommodation of differing lengths. A selectively connectable tapering leading edge element 20 is also utilised on a front edge of a leading user support element 22 to aid admission of wheelchairs onto the ramped portion 18 and to facilitate disembarkation.

The user support elements 12 also include a top platform element 24 which is generally level for positioning at the height of the building entrance/exit. The user support elements 12 are all selectively interconnectable, for example, using snap-fit or drop-in tongue and groove joints. If separate screw-threaded fasteners for interconnecting the user support elements 12 can be avoided, this simplifies installation.

Upper surfaces 26 of the user support elements 12 preferably include a slip-resistant, for example textured, surface 28 which may be tactile such as rubberised. Although metal, such as galvanised steel or aluminium may be considered, the user support elements 12 may beneficially be formed of rigid plastics which provided for longevity and reduced weight.

A step and gate system 30 preferably also leads to the top platform element 24 of the user support elements 12. The steps 32 are also non-slip and may be selectively height adjustable to accommodate a specific user and the terrain of installation. Advantageously, each step 32 may include a rubberised or other non-slip edging 34, preferably of a contrasting colour or tone. The gate 36 at the top of the steps 32 is beneficial in preventing or inhibiting a user stumbling down the steps 32 from the top platform element 24. The gate 36 is preferably self-latching, for example being provided on rising or gravity hinges or by utilising spring biasing to a closed position. The gate 36 is dimensioned to extend to the same or substantially same height as the handrail 16. In this way the gate 36 can be utilised as part of the handrail 16 to aid a user when utilising the ramp 10.

The handrails 16 and the gate 36 may beneficially also have a tonal contrast which is different from the steps and/or edge elements to aid visibility and recognition, particularly for the ocularly impaired. The handrails 16 and the gate 36 may additionally themselves have different colours or tonal contrast to aid differentiation therebetween.

The handrails 16 and gate 36 comprise elongate rigid members 38, which again may be plastics. The handrails 16 include elongate upper and lower handrail members 40, 42 which extend between upright handrail supports 44. The ends 46 of the upper and lower handrail members 40, 42 at the front edge of the leading user support element 22 are interconnected to be smoothly and arcuately continuous. The interconnected leading ends 46 of the upper and lower handrail members 40, 42 are preferably asymmetrical in a vertical plane to provide a non-vertical sloping portion 48 as a lead for a user's hand onto the handrail 16. The lower handrail member 42 is beneficial in guiding a downwards looking user along the ramp 10, whilst also aiding recovery in the event of a fall.

The edge elements 14 in this case are separate and connectable to the side edges of each user support element 12. The edge elements 14 are elongate sections, preferably being plastics or metal. A lateral extent of the edge elements 14 is greater than a thickness of the user support element 12. Once connected, each edge element 14 protrudes above the top surface 50 of the user support element 12, thereby functioning as a kick- or toe-plate. Although separate of the user support element 12, the edge elements 14 may be integrally formed as one-piece therewith.

The edge element 14 includes a first channel 52 which extends longitudinally along its outer wall, and a second channel 54 which extends longitudinally along its bottom edge. Both the first and second channels 52, 54 may be at least in part keyways, and thus may include, for example, an in turned and uniformly continuous channel edge or edges at the respective longitudinal channel openings.

The edge elements 14 may be a snap-fit connection to the user support element 12, and/or may be fastened by screw-threaded fasteners.

The upright handrail supports 44 are preferably rigid tubular elements being at least in part hollow. A bottom end 56 of each handrail support 44 is slidably received in a, preferably moulded plastics or die-cast metal, support connector 58. The support connector 58 may have a tapering connector body 60 and a projecting hooked runner 62 which is slidably engagable with the first channel 52 of the edge element 14. In this case, the runner 62 is hooked below an in turned edge so as to sit and slide in the first channel 52. The tapering of the connector body 60 to provide an increased wall thickness is beneficial in strengthening the region at the runner 62.

The connector body 60 is preferably open at both ends. The bottom end 64 of the connector body 60 may include an in-turned flange to seat an end of the handrail support 44. An adjustable elongate first ramp support 66 is insertable through the bottom end 64 of the connector body 60 so as to depend therefrom. The first ramp support 66 has a rigid elongate upright shaft 68 and a load bearing foot 70 at one end of the shaft 68. The rectilinear shaft 68 is telescopically slidably receivable within the tubular hollow handrail support 44 so as to be coaxial therewith, extendable therefrom and retractable thereinto. A detent 72, for example being a sprung pip and aperture arrangement or a locking split pin, can be utilised between the handrail support 44 and the shaft 68 of the first ramp support 66 to provide for lengthwise height adjustment.

Preferably, a fastener 74, such as a screw or bolt, is used through the connector body 60 and runner 62 to fixedly connect the handrail support 44 directly to the connector body 60; the shaft 68 of the first ramp support 66 to the handrail support 44; the connector 58 fixedly to the edge element 14 to prevent further sliding movement in the first channel 52; and the edge element 14 to the user support element 12.

The first ramp support 66 includes a, preferably one-piece, part-spherical head element 76 which is fixedly attached to a distal lowermost end of the shaft 68. The foot 70 includes a cup 78 which is generally trapezoidal shaped for load spreading, but other shapes can be envisaged. The cup 78 may be one-piece and is typically moulded plastics with a preferably textured or treaded flat lower surface 80 for bearing against and gripping the ground. The cup 78 includes a smooth part-spherical bearing surface 82 in its upper surface and which is complementarily shaped to captively engage the part-spherical head element 76. Captive engagement is preferably via a push-fit insertion of the head element 76 into the cup 78. By forming the bearing surface 82 of the cup 78 so as to extend just beyond the equatorial line, the head element 76 is retainable without additional fixings and fastenings.

The part-spherical head element 76 and the part-spherical bearing surface 82 of the cup 78 enable the foot 70 to freely pivot in at least the plane of the longitudinal extent of the shaft 68 of the first ramp support 66 and laterally thereof. The foot 70 can also freely rotate through 360 degrees on the head element 76.

The first ramp support 66 can thus accommodate various kinds of terrain via its length adjustment and the freely pivotable and rotatable foot 70. Foot 70 may also beneficially include fixing holes for ground spikes or fasteners to be inserted allowing the foot to be retained in position.

The first ramp support 66 is typically utilised for supporting the top user support element 22 and steps 32. To support the user support elements 12 forming the sloping ramped portion 18, height adjustable second ramp supports 84 are preferably utilised to accommodate the varying height and also the terrain.

This second ramp support 84 comprises a foot 86 and two arms 88. Although the arms 88 in this embodiment have fixed lengths, they could conceivably be length adjustable, for example by being telescopic. They may also be of fixed but different lengths. The foot 86 is as described above and includes the cup 78 having the part-spherical bearing surface 82. The two arms 88 are pivotably engaged with the foot 86 on a common pivot axis and each arm 88 includes a slider 90 at the distal end of an arm member 92 remote from the foot end. Each arm member 92, preferably being metal, is rigid and may be rectilinear though cranking along the longitudinal extent may be utilised. Each slider 90 comprises a slider body 94 which straddles the distal end of the arm member 92 and which is pivotably engaged therewith. Each slider 90 is preferably metal, and is slidably received in the second channel 54 in the lowermost surface of a bottom edge of the edge element 14 via a second runner 96 which projects upwardly from the slider body 94. The second runner 96 is preferably a key which is engagable with the second channel 54 being a keyway.

The slider body 94 may include inner and outer fixing arms. The inner fixing arm is provided within the second channel 54, and the outer fixing arm overlies but is spaced from the inner fixing arm so as to lie over the longitudinal opening of the second channel 54. A fastening, such as a screw-threaded shaft passes between the inner and outer fixing arms. The screw-threaded shaft passes through the outer fixing arm. Once the slider 90 is correctly positioned, a nut or other suitable fastening device can be used to tighten the inner and outer fixing arms together so as to sandwich and clamp channel edges of the second channel 54 therebetween. Consequently, the slider 90 is fixedly held in position.

Due to the independent pivoting engagement of the arms 88 with the foot 86, the second ramp support 84 is not only slidable along the second channel 54 of the edge element 14 to adjust the position of the entire second ramp support 84, but the sliders 90 are also independently slidable along the second channel 54. The independent sliding of the sliders 90 varies the relative angular position of the arms 88, providing a scissors action. The distance of the foot 86 from the edge element 14 is thus selectively variable, and when clamping the sliders 90 in position, is selectably gettable depending on the required height of the user support elements 12.

The proximal end of each arm 88 of the second ramp support 84 includes a part-spherical pivot element 98 which is receivable in the cup 78 of the foot 86. Each pivot element 98 is preferably moulded plastics and includes a flat 100 which extends in parallel with a plane of the longitudinal extent of the respective arm 88 of the second ramp support 84. The flat 100 of each pivot element 98 is abuttable with the flat 100 of the other pivot element 98 to provide a part-spherical second head element 102. In this way, the second head element 102 is symmetrical about the abutting plane of the flats 100, with the pivot elements 98 being mirror images of each other.

The two part second head element 102 can thus be pressed into the cup 78 of the foot 86 as a snap-fit captive engagement, in the same manner as described above. The smooth part-spherical bearing surface 82 of the cup 78 and the part-spherical surface of the two part second head element 102 allows the foot 86 to freely pivot in at least the plane of the arms 88 and laterally thereof, whilst also being able to rotate through 360 degrees. The arms 88 act as stops against which the foot 86 can abut if pivoted too far, thereby limiting the possibility of separation of the second head element 102 from the cup 78.

With the second head element 102 engaged with the foot 86, the pivot elements 98 are independently pivotable relative to each other in a plane of the edge element 14, and the foot 86 can independently pivot in at least two perpendicular directions whilst also being rotatable independently of the pivot elements 98. This again allows the foot 86 to accommodate different kinds of terrain at an installation location, whilst allowing the second ramp support 84 to be positioned along the edge element 14 to accommodate the most convenient and positive ground engagement location and height adjusted as required via the scissor action of the arms 88.

It is thus possible to provide a modular ramp which offers benefits over other known ramps. The modular ramp of the present invention can be easily removed, reconfigured and reused in different locations or to return a property to its original state. The ramp is light weight, and provides flexible and quick installation with a minimum number of parts and fastenings. Assembly can be undertaken by a single installer. By providing a multi-plane angularly adjustable foot utilising a ball joint, rough and uneven ground is easily accommodated without any or significant preparatory groundwork. The moveable ramp supports also facilitate installation on many different kinds of terrain without any or significant preparatory groundwork. The first and second ramp supports allow for precise height adjustment, and the second ramp support utilising two angularly spaced arms distributes loading over two points. It is also possible to provide a ramp having user support elements with a common interface, facilitating easy interconnection.

The embodiments described above are provided by way of examples only, and various other modifications will be apparent to persons skilled in the field without departing from the scope of the invention as defined by the appended claims.

What is claimed is:

1. A ramp comprising a user support element, an edge element at an edge of the user support element, a handrail, a support connector which is slidably engagable with the edge element, an elongate upright handrail support, and an adjustable elongate depending ramp support, wherein the handrail support and the ramp support are coaxially held by the support connector.

2. The ramp as claimed in claim 1, wherein the ramp support is slidably adjustable relative to the handrail support.

3. The ramp as claimed in claim 1, further comprising a releasable detent for holding the ramp support in a selected position relative to the handrail support and support connector.

4. The ramp as claimed in claim 1, wherein a single fastener engages the support connector with the edge element and the handrail support and ramp support with the support connector.

5. The ramp as claimed in claim 1, wherein the support connector is open ended to receive the handrail support and the ramp support coaxially therein.

6. The ramp as claimed in claim 1, wherein the support connector includes a connector body for receiving the handrail support and the ramp support, and a projecting runner which is slidably engagable with a channel of the edge element.

7. The ramp as claimed in claim 6, wherein the channel is in a side wall of the edge element.

8. The ramp as claimed in claim 1, wherein the user support element and edge element is modular for ramps of different lengths.

9. A ramp comprising a user support element, an edge element at an edge of the user support element, and a height adjustable ramp support which includes a foot and two arms pivotably engaged with the foot, each arm having a slider pivotably engaged at its distal end remote from the foot, each slider being slidably engagable with the edge element for lengthwise adjustment of the ramp support along the edge element and for slidable adjustment relative to each other so as to set a distance between the edge element and the foot, each slider being fixedly holdable in place to maintain a set position.

10. The ramp as claimed in claim 9, wherein each slider includes a slider body which is pivotably engaged with the distal end of the arm, and a projecting runner which is slidably engagable with a channel of the edge element.

11. The ramp as claimed in claim 10, wherein the runner extends from an upper surface of the slider body.

12. The ramp as claimed in claim 9, wherein the slider body straddles the distal end of the arm.

13. The ramp as claimed in claim 9, wherein the arms have a common pivot axis at the foot.

14. The ramp as claimed in claim 9, further comprising a releasable fastening device for fixedly holding each slider at its set position.

15. The ramp as claimed in claim 9, wherein the foot is pivotable relative to both said arms simultaneously.

16. A ramp comprising a user support element, an edge element at an edge of the user support element, and a height adjustable ramp support which includes a foot and two arms, each arm having a part-spherical pivot element at a proximal end thereof, each pivot element being abuttable with the other pivot element to provide a part-spherical head element, the foot including a cup having a part-spherical bearing surface which is complimentarily shaped to captively engage the part-spherical head element whereby the pivot elements can independently pivot relative to each other and the foot can pivot independently of the pivot elements in at least the plane of the arms and laterally of the arms.

17. The ramp as claimed in claim 16, wherein the foot is snap-fittably engagable with the part-spherical head element.

18. The ramp as claimed in claim 16, wherein each pivot element includes a flat which is abuttable with the flat of the other pivot element to provide the part-spherical head element.

19. The ramp as claimed in claim 16, wherein the foot is rotatable through 360 degrees on the part-spherical head element.

20. The ramp as claimed in claim 16, wherein the foot can pivot in at least two perpendicular directions.

* * * * *